US011731801B2

(12) United States Patent
Pierozan

(10) Patent No.: US 11,731,801 B2
(45) Date of Patent: Aug. 22, 2023

(54) FOLDED LEAK-PROOF CONTAINER WITH SIDE HANDLES AND A TOP HANDLE

(71) Applicant: Jean Carlos Pierozan, Rio Grande do Sul (BR)

(72) Inventor: Jean Carlos Pierozan, Rio Grande do Sul (BR)

( * ) Notice: Subject to any disclaimer, the term of this patent is extended or adjusted under 35 U.S.C. 154(b) by 298 days.

(21) Appl. No.: 17/307,239

(22) Filed: May 4, 2021

(65) Prior Publication Data

US 2021/0300619 A1 Sep. 30, 2021

Related U.S. Application Data

(63) Continuation-in-part of application No. PCT/BR2019/050493, filed on Nov. 13, 2019.

(51) Int. Cl.
*B65D 5/46* (2006.01)
*B65D 5/20* (2006.01)
*B65D 5/24* (2006.01)

(52) U.S. Cl.
CPC ..... *B65D 5/46024* (2013.01); *B65D 5/2052* (2013.01); *B65D 5/244* (2013.01)

(58) Field of Classification Search
CPC .... B65D 5/241; B65D 5/248; B65D 5/46144; B65D 5/6697; B65D 2571/0045; B65D 5/2057; B65D 5/242; B65D 5/247; B65D 81/38; B65D 81/18; B65D 81/3813; B65D 5/46024; B65D 5/2052; B65D 5/244; B65D 5/6632; B65D 5/4608; Y02A 40/963; Y02W 30/80
USPC .... 229/117.19, 186, 117.15, 117.05, 117.24, 229/117.13, 117.16, 117.25, 125.19, 229/125.28, 145, 165, 188, 138, 172, 175, 229/193, 194; 206/169, 427; 220/592.2; 428/43
See application file for complete search history.

(56) References Cited

U.S. PATENT DOCUMENTS

| | | | | |
|---|---|---|---|---|
| 2,151,472 A * | 3/1939 | Hubbard | B65D 5/248 229/117.17 |
| 2,508,909 A | 3/1949 | Evans et al. | |
| 2,690,289 A | 9/1954 | Claus et al. | |
| 3,182,913 A * | 5/1965 | Brian | B65D 5/247 229/117.14 |
| 3,301,586 A | 1/1967 | Lisiecki | |
| 3,395,850 A | 10/1968 | Kotowick | |
| 4,214,695 A | 7/1980 | Cooper | |
| 4,340,169 A | 7/1982 | Webinger | |
| 4,942,644 A | 7/1990 | Rowley | |
| 5,284,294 A * | 2/1994 | Floyd | B65D 65/403 229/179 |

(Continued)

*Primary Examiner* — Christopher R Demeree
(74) *Attorney, Agent, or Firm* — Bay State IP, LLC

(57) ABSTRACT

The following summary concerns the development of a folded leak-proof container (46) that consists of one piece of fiberboard or cardboard (1) containing slits and folds that produce the center panel (3), the top panel (4), the bottom panel (5), the side panels (6 and 7), and the end panels (8-15), the latter of which contain lengthwise slits (18-25) to be folded in order to form the side handles of the container (46); the container may also include a top handle (2). The main function of the container (46) is to keep cool, transport, and cool items that must be refrigerated; it can do so through the addition of ice or any coolant compatible with the material used to manufacture the container.

3 Claims, 3 Drawing Sheets

(56) References Cited

U.S. PATENT DOCUMENTS

| | | | | |
|---|---|---|---|---|
| 7,841,512 | B2 * | 11/2010 | Westerman | B65D 5/6697 229/149 |
| 10,246,213 | B2 * | 4/2019 | Ayerst | B65D 5/54 |
| 10,611,514 | B1 * | 4/2020 | Costanzo, Jr. | B65D 5/46112 |
| 2013/0026059 | A1 | 1/2013 | Jenkins | |
| 2015/0336730 | A1 * | 11/2015 | Shields | B65D 5/563 493/95 |
| 2017/0066553 | A1 * | 3/2017 | Costanzo, Jr. | B65D 5/4612 |
| 2020/0140179 | A1 * | 5/2020 | Costanzo, Jr. | B65D 5/6655 |
| 2020/0270013 | A1 * | 8/2020 | Costanzo, Jr. | B65D 5/643 |
| 2022/0281633 | A1 * | 9/2022 | Costanzo, Jr. | B65D 5/6655 |

* cited by examiner

FOLDED LEAK-PROOF CONTAINER WITH SIDE HANDLES AND A TOP HANDLE

TECHNICAL DOMAIN

This descriptive report concerns the development of a folded container with side handles and a top handle, the principal purpose of which is to serve as a leak-proof container that is easy to assemble, easy to pick up, and safe to carry with one hand. This container may be used to keep cool, transport, and cool (through the use of ice or any other coolant compatible with the container material) items placed within it.

PRIOR ART

The prior art relevant to the creation of folded leak-proof containers is located in the following patents: U.S. Pat. Nos. 9,457,929 B2, 7,841,512 B2, 7,748,603 B2, 6,837,420 B2, 6,736,309 B1, 6,253,993 B1, 5,853,121 A, 5,307,986 A, 5,284,294 A, 5,062,527 A, 5,016,813 A, 4,340,169 A, 4,328,923 A, 4,238,069 A, 4,119,265 A, 2,008,443 A, and 529,053 A.

The handle used on the folded leak-proof box is described in U.S. Pat. Nos. 6,736,309 B1 and 529,053 A.

A folded leak-proof container with side handles is described in U.S. Pat. No. 7,841,512 B2.

Folded leak-proof containers with handles belonging to the container itself are described in the following patents: U.S. Pat. Nos. 7,748,603 B2, 6,837,420 B2, 6,253,993 B1, 5,853,121 A, 5,284,294 A, 4,238,069 A, and 2,008,443 A.

Technical Problem

The folded leak-proof container with a handle described in U.S. Pat. No. 6,736,309 B1 presents a handle that is attached to the lid of the container. This arrangement does not allow for the container to be opened while it is being carried by the handle. Furthermore, the two overlapping panels that constitute the lid and its locking system do not provide sufficient structure or locking to withstand the force and/or vibrations created when the container is carried by the handle.

The paper pail with a handle described in U.S. Pat. No. 529,053 A does not have side handles so that it can be more easily lifted using two hands, since the flaps that fold outside and over each other on each side of the bucket were not conceived in a way that allows for lengthwise cuts wide enough for hands to fit; they have holes large enough only for the attachment of the tips of the handle. After being inserted into the holes on the flaps, the end of the handle does not completely wrap around the paper layers that form the flaps; it is only folded upward toward the flaps so that the handle may swing freely from the top to the sides of the pail and so that the lid may be opened without the removal of the handle. However, the ends of the handle are able to separate from the flaps of the pail in situations involving substantial vibration and/or weight. Once it is folded, the pail is locked only through the use of the handle.

The folded leak-proof container described in U.S. Pat. No. 7,841,512 B2 has side handles that are formed by large cuts into the side panel and end panel of each side of the container. Because the end panel contains larger cuts and is folded inward, the side panel with the cut is folded outward over the adjacent end panel; when the user's hand enters the cut in the side panel aligned with the larger cuts on the end panel and is put into direct contact with the ice that may be inside the container. Because only one end panel on each side of the container has large cuts and because it is folded with the adjacent side panel with the larger cut, the overlapping material is limited, which, in turn, limits the resistance of the container's side handles.

The handles on the folded leak-proof containers described in U.S. Pat. Nos. 7,748,603 B2, 6,837,420 B2, 6,253,993 B1, 5,853,121 A, 5,284,294 A, 4,238,069 A, and 2,008,443 A are part of the container itself. Because the vast majority of these containers are made out of paper or cardboard or corrugated fiberboard, materials that are not resistant to shear strength, this type of handle attached to the container will tear easily if the user carrying the container by the handle turns his or her hand. This arrangement also does not allow for the container to be opened while it is being carried by the handle.

The folded leak-proof containers described in U.S. Pat. Nos. 9,457,929 B2, 5,307,986 A, 5,062,527 A, 5,016,813 A, 4,340,169 A, 4,328,923 A, and 4,119,265 A were developed without side handles, thus limiting the quality of the user's experience.

Solution to the Problem

To resolve these inconveniences, the current leak-proof container with side handles, folded from a single blank and preferably made of corrugated fiberboard and a handle preferably made of flexible plastic material attached to the side handles has been developed.

All of the end panels contain two cuts made lengthwise, for a total of four end panels and eight lengthwise cuts. The two end panels on each side of the container are folded outward over the others adjacent to the side panel, which is folded inward prior to the end panels being folded; the four lengthwise cuts belonging to the end panels on each side of the container are aligned and thus form side handles. The side panels do not contain any cuts and are folded inward prior to the folding of the end panels and remain in direct contact with the inside of the container; thus, when the user places his or her hands inside the side handles of the container, the side panels prevent his or her hands from coming into direct contact with the inside of the container and, in doing so, protect them.

For the container to be locked without the need for glue and without requiring the use of the handle, two locking flaps have been created to lock the end panels on each side of the container. Each locking flap contains a lengthwise slit that aligns with the four lengthwise slits made into the end panels after they are locked. The locking flaps also contribute to the side handles of the container and thus allow for the overlap of five layers of material, resulting in very resistant handles that do not require an increase in the dimensions of the single blank to create reinforcement layers.

Each end of the handle is inserted through the lengthwise slits of each side handle and therefore completely wraps around the layers overlapping the end panels of each side of the container (whether it compresses them or not), and the end panels are locked to improve the safety of the assembled container. Because the top handle is attached to the container using the side handles, support is provided on each side by at least four layers of material (five when the locking flap is used). This overlap of five layers of material improves the safety of the container, allowing it to support more than 10 kg whether it is carried by the side handles or the top handle.

The arrangement of the proposed container also relies on a lid that is split down the middle. The two-sided lid and the attachment of the top handle to the side handles allows for the lid to be opened or closed while the container is being held up by the top handle.

Advantages of the Invention

The folded leak-proof container with side handles and a top handle includes innovative slits and folds designed on a single blank preferably made of corrugated fiberboard and with a top handle with a simple locking system preferably made of low-density polyethylene. The container was developed (i) to be leak-proof, resistant, easy to assemble, and safe; (ii) to offer the best user experience to the consumer; (iii) to minimize the costs of materials, production, transport, and stock; and (iv) to have as little environmental impact as possible, since it can also be produced using recycled cardboard or plastic.

The folded leak-proof container with side handles and a top handle may be used as a low-cost cooler for keeping drinks cold through the addition of ice and is therefore an alternative to bags and ice chests produced using spray foam, which are more expensive to produce, more difficult to be recycled or reused, and which are not biodegradable. The container may also be used as a shopping basket, since the lid can be opened and closed while it is being held by the handle; it is therefore an alternative to reusable grocery bags. Because the container is assembled using a folding system, it can be assembled or disassembled whenever it is convenient.

A BRIEF DESCRIPTION OF THE FIGURES

The physical description of this folded leak-proof container with side handles and a top handle is supported by drawings of the design and assembly so that the object may be produced in its entirety by a trained technician who is clear on the functions of the object in question.

The written description is based on the figures and reference numbers therein, which express the best or preferred way to create the object. The description clarifies aspects that may be misunderstood based on the images alone in order to clearly outline the intentioned design.

These figures are meant to be suggestions, and the final object may vary as long as it does not stray from the purpose proposed.

DESCRIPTION OF ASSEMBLY

Figure 1:
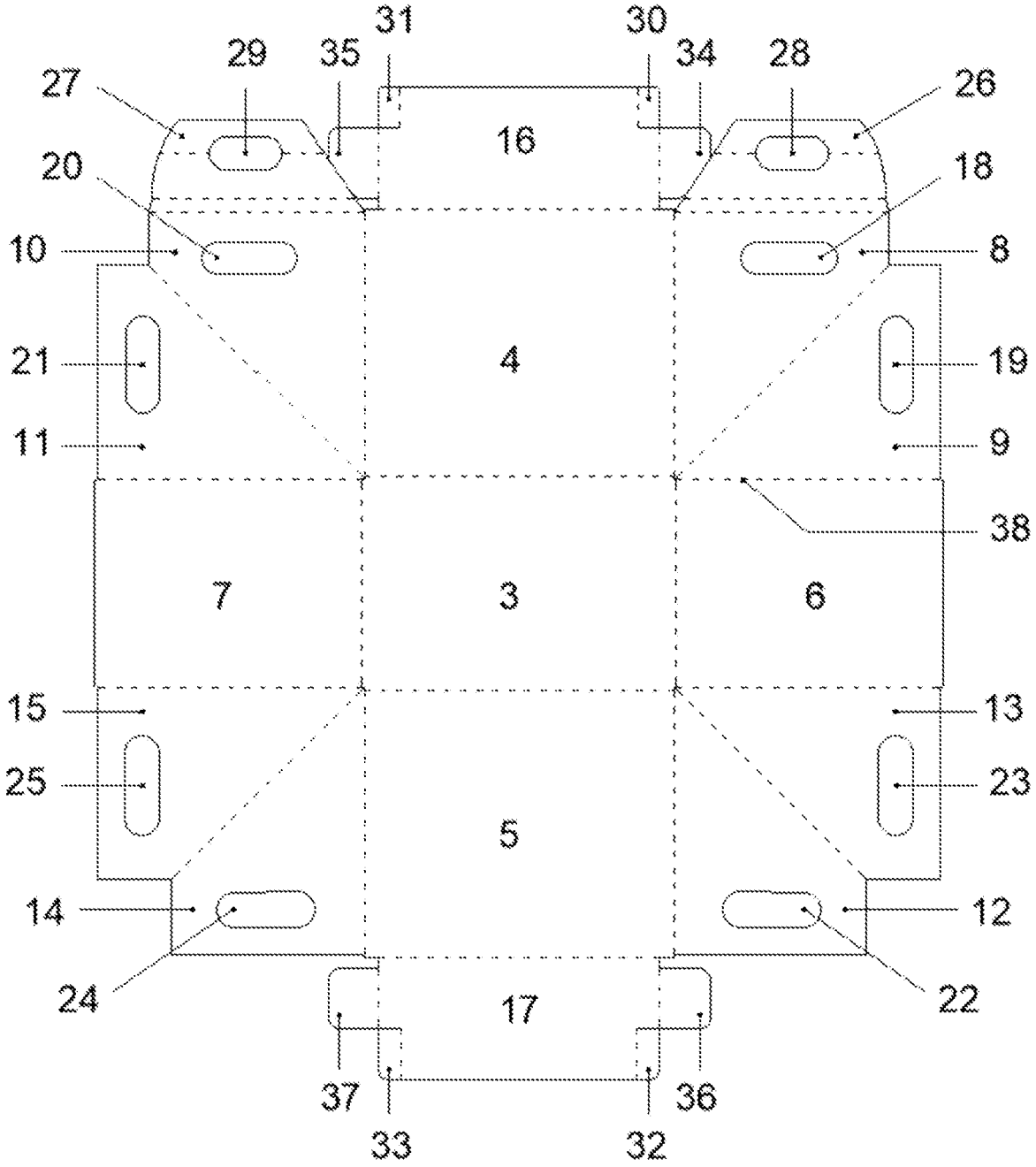
FIG. 1 shows the open container to reveal the slits and folds.
Figure 2:
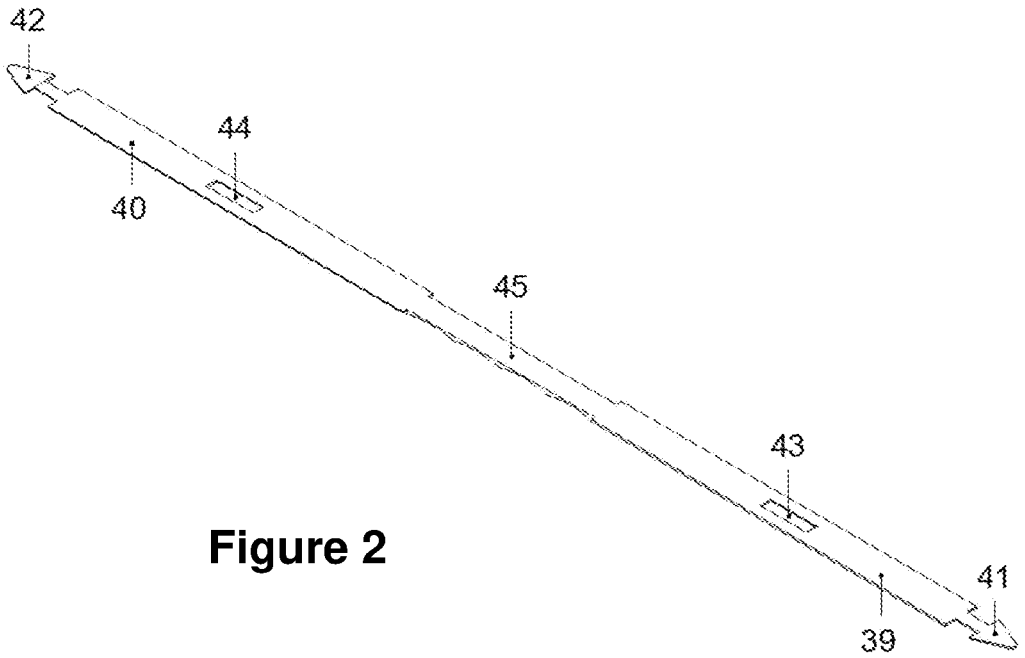
FIG. 2 shows a model of the top handle that may be applied to the container.
Figure 3:
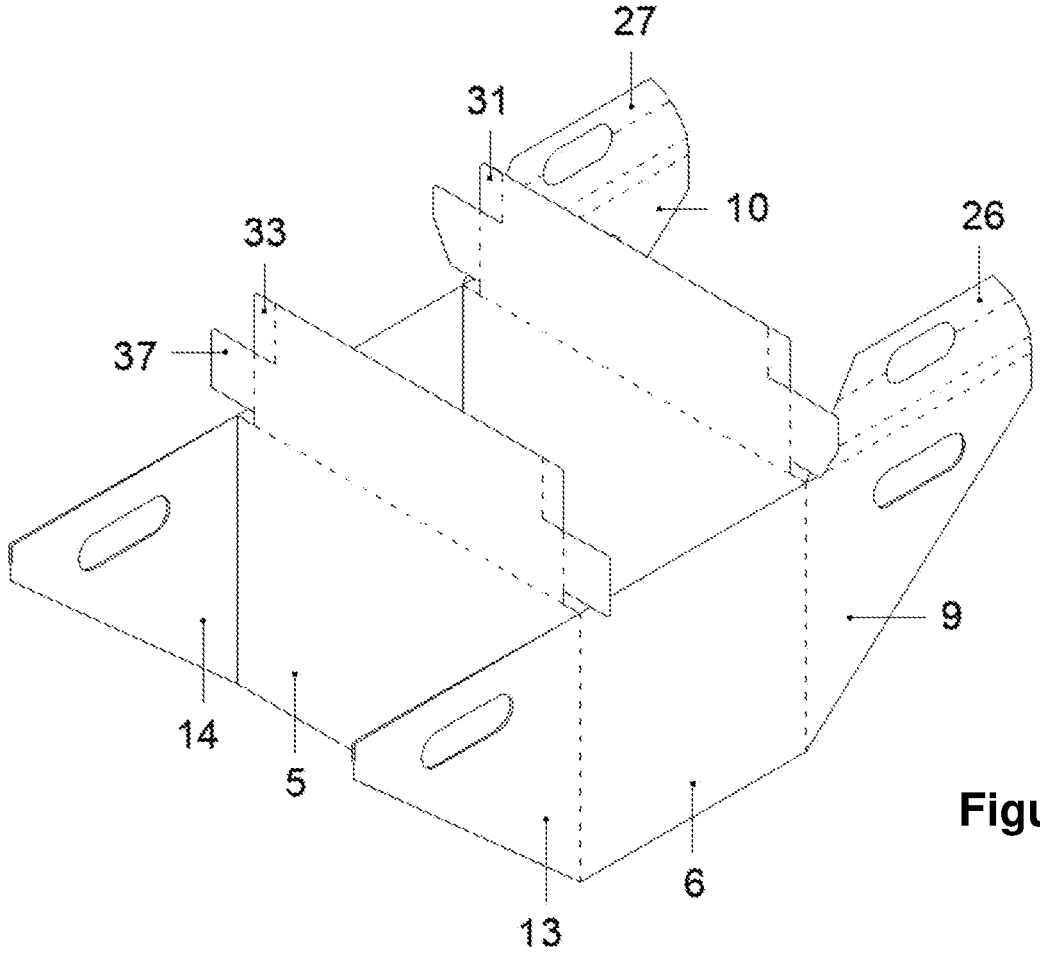
FIG. 3 shows the container partly folded.
Figure 4:
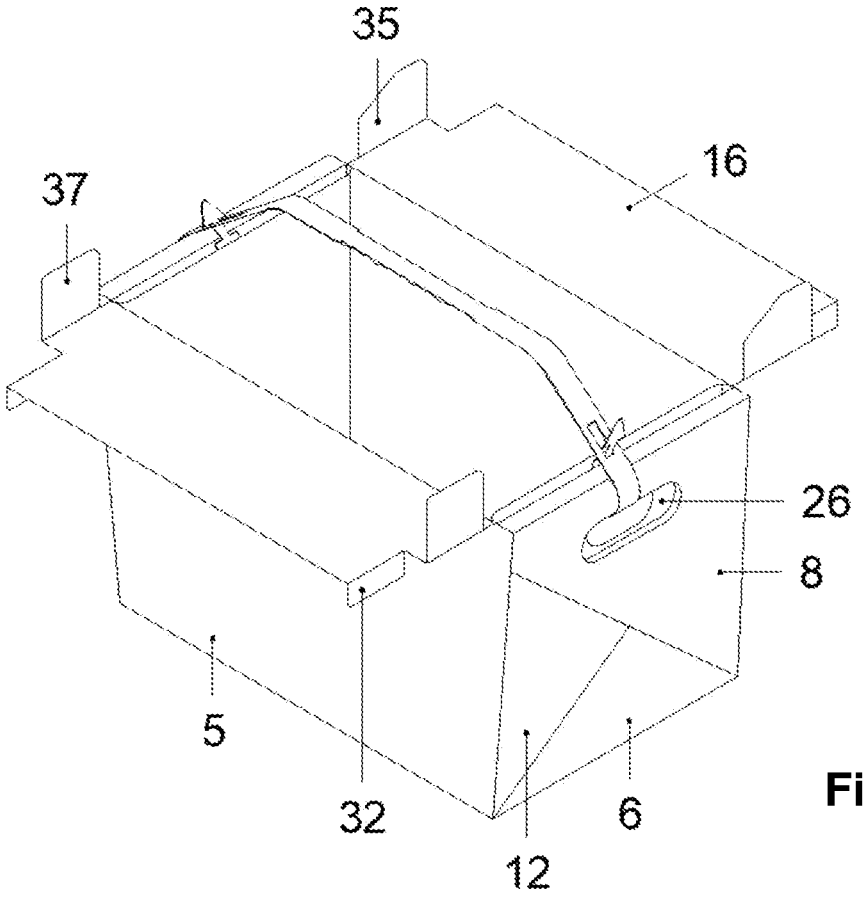
FIG. 4 shows the folded container, with the top handle attached and the lid open.
Figure 5:
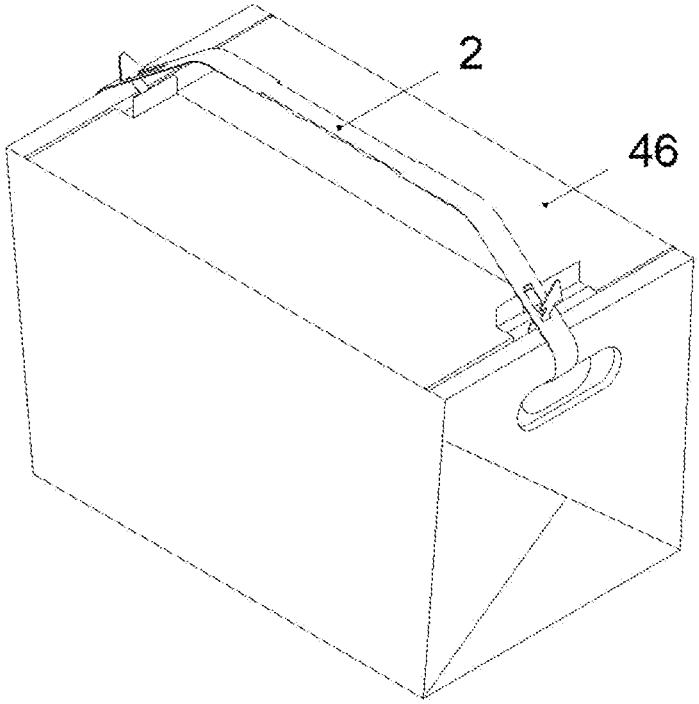
FIG. 5 shows the folded container, with the top handle attached and the lid closed.

The preferred method for assembling the container (46) consists of a piece of fiberboard (1) containing slits and folds that produce the center panel (3), the top panel (4), the bottom panel (5), the right side panel (6), the left side panel (7), the right top inner end panel (8) with a lengthwise slit (18); the right top outer end panel (9) with a lengthwise slit (19), the left top inner end panel (10) with a lengthwise slit (20), the left top outer end panel (11) with a lengthwise slit (21), the bottom right inner end panel (12) with a lengthwise slit (22), the bottom right outer end panel (13) with a lengthwise slit (23), the bottom left inner end panel (14) with a lengthwise slit (24), the bottom left outer end panel (15) with a lengthwise slit (25), the top lid panel (16), the bottom lid panel (17), the right locking flap (26) with a lengthwise slit (28), the left locking flap (27) with a lengthwise slit (29), the right top lid flap (34), the left top lid flap (35), the right bottom lid flap (36), the left bottom lid flap (37), the top right shock-absorbing flap (30), the top left shock-absorbing flap (31), the bottom right shock-absorbing flap (32), and the bottom left shock-absorbing flap (33).

The horizontal, vertical, and diagonal watertight interlocking folding system (38) allows for the top panel (4), the bottom panel (5), the right side (6), and the left side (7) to be folded inward using the center panel (3), and the inner end panels (8, 10, 12, and 14) to be folded over their respective outer panels (9, 11, 13, and 15), thus aligning their respective lengthwise slits. These folds prevent melting water to leak from the container.

The bottom right end panels (12 and 13) are folded outward over their respective right side panels (6); next, the upper right end panels (8 and 9) are folded outward over their respective bottom right side panels (12 and 13), thus aligning their respective lengthwise slits (18, 19, 22, and 23). This process is mirrored on the left side. The right locking flap (26) is folded starting from the top right inner end panel (8) and inserted into the right side panel (6) and the bottom right outer end panel (13), thus locking the right end panels (8, 9, 12, and 13) and aligning its lengthwise slit (28) to the other lengthwise slits (18, 19, 22, and 23). This process is mirrored on the left side. These folds make up the side handles of the container and render it highly resistant due to the overlap of five cardboard or fiberboard layers. The locking flaps made from the inner end panels take advantage of the spaces in the cardboard or fiberboard piece on the side of the lid panels that would otherwise be discarded, thus saving material.

The top lid panel (16) and the bottom lid panel (17) are folded from their respective top panel (4) and bottom panel (5), and they meet in the middle. The top right lid flap (24) and the bottom right lid flap (36) are folded from their respective top lid panel (16) and bottom lid panel (17) and introduced into the right side panel (6) and the bottom right outer end panel (13). This process is mirrored on the left side. The lid panels folded from their respective top and bottom panels keep them from bulging outward from these panels. The lid flaps inserted into the side panels and the outer bottom end panels prevent the lid panels from collapsing into the container and allow for the structure of the lid panels to resist bending.

The top handle (2) of the container (46) has a central grip (45), a slot on the far right (39), and a slot on the far left (40). The far right tip (39) is introduced through the aligned lengthwise slits (18, 19, 22, 23, and 28) of the right end panels (8, 9, 12, and 13) and of the right locking flap (26); next, it is tied through the aforementioned slots in order to lock the handle in (2). This process is mirrored on the left side. The handle ties formed on the sides of the handle go around all of the cardboard or fiberboard layers of the end panels and locking flaps in order to completely lock the handles onto the container.

The preferred material for the manufacturing of the top handle (2) is one that is flexible and that has tips (39 and 40) that are pointed or easy to lock (41 and 42), as well as small slots for these tips (43 and 44). A bendable handle (39) will allow for the insertion of its tip (41) into the small slot (43), and, once the torsion is released, the tip (41) will lock into the small slot (43) as it is tied. This process is mirrored on the left side.

The lengthwise slits (18, 19, 22, 23, 28) of the right end panels (8, 9, 12, and 13) and of the right locking flap (26), as well as the right lid flaps (34 and 36), allow for lateral mobility of the right end of the handle (39); thus, the lid panels (16 and 17) may be easily opened and closed. This process is mirrored on the left side. The top right shock-absorbing flap (30) belonging to the top lid panel (16) and the bottom shock-absorbing flap (32) belonging to the bottom lid panel (17) absorb the impact of the far right side of the top handle (39) when the container is bent, keeping the lid panels (16 and 17) intact. This process is mirrored on the left side.

The invention claimed is:

1. FOLDED LEAK-PROOF CONTAINER WITH SIDE HANDLES AND A TOP HANDLE consists of a single blank (1), a top handle (2) with a far right end (39) and a far left end (40), the aforementioned blank (1) with a center panel (3), a top panel (4), a bottom panel (5), a right side panel (6), a left side panel (7), a top right inner end panel (8), a top right outer end panel (9), a top left inner end panel (10), a top left outer end panel (11), a bottom right inner end panel (12), a bottom right outer end panel (13), a bottom left inner end panel (14), a bottom left outer end panel (15), a system of multi-directional interlocking watertight folds (38) that match up with the adjacent panels (3-15), characterized by the aforementioned blank (1) having lengthwise slits (18-25) for each respective end panel (8-15), a top lid panel (16) made out of a fold at the top panel (4), a bottom lid panel (17) made out of a fold in the bottom panel (5), a right locking flap (26) made out of a fold in the top right inner end panel (8) or the bottom right inner end panel (12), a left locking flap (27) made out of a fold in the top left inner end panel (10) or the bottom left inner end panel (14), lengthwise slits (28 and 29) for each respective locking flap (26 and 27), a top right lid flap (34) and a top left lid flap (35) made out of folds at the top lid panel (16), a bottom right lid flap (36) and a bottom left lid flap (37) made out of folds in the bottom lid panel (17), a top right shock-absorbing flap (30) and a top left shock-absorbing flap (31) belonging to the top lid panel (16), and a bottom right shock-absorbing flap (32) and a bottom left shock-absorbing flap (33) belonging to the bottom lid panel (17).

2. FOLDED LEAK-PROOF CONTAINER WITH SIDE HANDLES AND A TOP HANDLE from claim 1 is characterized by the right side panel (6) and the left side panel (7) that fold inward, the bottom right end panels (12 and 13) and bottom left end panels (14 and 15) that fold outward over the right side panel (6) and the left side panel (7) respectively, the top right end panels (8 and 9) and the top left end panels (10 and 11) that fold outward over the bottom right end panels (12 and 13) and the bottom left end panels (14 and 15) respectively, the right end panels (8, 9, 12, and 13) and the left end panels (10, 11, 14, and 15) that overlap enough for the respective right lengthwise slits (18, 19, 22, and 23) and left lengthwise slits (20, 21, 24, and 25) to be aligned, the right locking flap (26) and the left locking flap (27) that are inserted respectively between the right side panel (6) and the bottom right outer end panel (13) and between the left side panel (7) and the bottom left outer end panel (15), the right lengthwise slit (28) for the right locking flap (26) and the left lengthwise slit (29) for the left locking flap (27) that align with the right lengthwise slits (18, 19, 22, and 23) and the left lengthwise slits (20, 21, 24, and 25) of the right end panels (8, 9, 12, and 13) and the left end panels (10, 11, 14, 15) respectively, the right lid flaps (34 and 36) that are inserted between the right side flap (6) and the bottom right outer end panel (13) plus the left lid flaps (35 and 37) that are inserted between the left side flap (7) and the bottom left outer end panel (15), the top lid panel (16) and the bottom lid panel (17) that overlap in the middle, the right shock-absorbing flaps (30 and 32) that overlap in the middle and the left shock-absorbing flaps (31 and 33) that overlap in the middle, the far right end of the handle (39) that is inserted into the lengthwise slits on the right side (18, 19, 22, 23, and 28) and which completely wraps around the right end panels and the right locking flap (8, 9, 12, 13, and 26), and the far left end of the handle (40) that is inserted into the lengthwise slits on the left side (20, 21, 24, 25, and 29) and which completely wraps around the left end panels and the left locking flaps (10, 11, 14, 15, and 27).

3. FOLDED LEAK-PROOF CONTAINER WITH SIDE HANDLES AND A TOP HANDLE from claim 1 is characterized by the handle (2) with two ends (39 and 40) that contributes to the locking system consisting of the tips of the handle (41 and 42) and small slots for these tips (43 and 44) and a central grip (45).

* * * * *